US006309083B1

(12) United States Patent
Lathrop et al.

(10) Patent No.: US 6,309,083 B1
(45) Date of Patent: Oct. 30, 2001

(54) CEILING FAN HAVING AN UP-LIGHT USING PIVOTING LIGHT SOCKETS

(75) Inventors: David Lathrop, Edwardsville, IL (US); Craig Phillip Johnson; Ed Springer, both of Chesterfield, MO (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 09/365,941

(22) Filed: Aug. 2, 1999

(51) Int. Cl.[7] ..... F21V 29/00

(52) U.S. Cl. ..... 362/96; 362/234; 362/238; 362/239; 362/350; 362/408; 416/5

(58) Field of Search ..... 362/96, 234, 238, 362/239, 350; 416/5

(56) References Cited

U.S. PATENT DOCUMENTS 636,871 * 11/1899 Wait ..... 416/5
905,089 * 11/1908 McBerty ..... 416/5
4,796,166 * 1/1989 Greenburg ..... 362/96
5,151,011 * 9/1992 Rezek ..... 416/5
5,404,284 * 4/1995 Davis, Jr. ..... 362/294
5,658,129 * 8/1997 Pearce ..... 416/5

* cited by examiner

*Primary Examiner*—Sandra O'Shea
*Assistant Examiner*—David V. Hobden
(74) *Attorney, Agent, or Firm*—Howrey Simon Arnold & White, LLP

(57) ABSTRACT

A pivoting light socket is used in the light pan of an up-light fixture of a low clearance ceiling fan, the light pan is positioned above the fan blades to provide indirect lighting which reflects from the ceiling above the fan blades. The circular, trough-shaped light pan surrounds, and is coupled to, the top circumference of the ceiling fan's motor stator, with the trough shaped portion positioned below the top of the stator. The light bulbs have a pivoting light socket that allows the bulb and socket to be positioned substantially below the top surface of the stator when the light socket is in its horizontal position, parallel to the top of the stator. Tilting the light socket upward, toward a vertical position, allows the light bulbs to be easily replaced, especially if the trough-shaped light pan is deep or narrow.

26 Claims, 6 Drawing Sheets

CEILING FAN HAVING AN UP-LIGHT USING PIVOTING LIGHT SOCKETS

BACKGROUND OF THE INVENTION

1. Field of the Invention

The invention relates generally to light sockets, and more particularly, to light sockets for ceiling fans having an up light.

2. Description of Related Art

Electric ceiling fans are commonly used to provide improved circulation in a room and assist heating and air conditioning systems. Known ceiling fans generally consist of an electric motor suspended by a shaft or down rod from a ceiling. Other ceiling fan styles are mounted such that there is little or no clearance between the top of the motor and the ceiling. These ceiling fans are known as "snugger" or "zero-clearance" fans, and are used where floor to ceiling clearance is too small for suspending the fan motor with a down rod. The motor includes a stationary portion (the stator) and a rotating portion (the rotor). A decorative housing surrounds the motor, with an opening provided in the lower portion of the housing to allow a plurality of blades to be mounted to the rotating portion. Conventional ceiling fans typically incorporate one or more electrical switches encased within a switch housing beneath the motor for controlling the speed and rotational direction of the blades.

Known ceiling fans often have light fixtures attached to the bottom portion of motor, below the blades. In many applications, the light fixture is mounted to the switch housing below the fan blades, with the light fixture lamps casting illumination in a downward fashion. In many applications, however, it is desirable to provide indirect lighting, such as casting light upward toward the ceiling above the fan.

With ceiling fans adapted to receive existing up-light fixtures, typically there is not sufficient clearance between the top of the motor and the ceiling from which the ceiling fan is suspended. This lack of clearance becomes problematic when it is time to replace the light bulbs in the up-light fixtures. Furthermore, when the up-light fixtures are located above the ceiling fans, the bulbs inside the up-light fixtures are hidden from view. The light sockets may also be placed in a narrow light pan, which leaves insufficient room for grasping and turning the bulb in a conventional light socket. Thus, to change a light bulb inserted in a conventional light socket, one would have to reach inside the light pan and grope for the bulb. This method is awkward and time consuming. Further, with the conventional light sockets, the light pan which contains the socket and bulb must necessarily be made large enough to accommodate sufficient room for threading or unthreading the bulb. Such a predicament results in design limitations on the size and shape of the light pan.

Hence, a need exists for an improved light socket for ceiling fans with an up-light feature. The present invention addresses these shortcomings associated with the prior art.

SUMMARY OF THE INVENTION

In a first aspect of the invention, the invention relates to pivoting light sockets to be placed in a light housing, which in one embodiment comprises a light socket and a pivoting arm. The arm includes a lower and an upper member. The upper member is pivotably attached to the lower member. The upper member is connected to the light socket, whereas the lower member is coupled to the light housing. In another embodiment, the arm is directly attached to the socket at one end and pivotably attached to the light housing at the other end. On the other hand, the arm may also be pivotably attached to the light socket.

In a second aspect of the invention, the light socket is pivotable from a first position to a second position. The first position refers to the light socket being parallel with the light housing. The second position refers to the light socket being perpendicular with the light housing. Alternatively, the second position refers to any position that is not parallel with the light housing.

In a third aspect of the invention, a ceiling fan that includes at least one pivoting light socket. The fan further includes a motor having a stator which has an upper portion and a rotor which has a lower portion that is rotatable with respect to the stator, and a plurality of fan blades. Each fan blade has a first end coupled to the lower portion of the rotor. The ceiling fan further includes at least one pivoting light socket coupled to the upper portion of the stator. The light socket is configured such that the illumination from the light bulb engaged therein projects above the fan blades.

In a fourth aspect of the invention, the fan further includes a light pan coupled to the upper portion of the motor. The motor defines a top surface and the light pan defines a circumferential trough, in which the light socket is situated. The trough is situated relative to the motor such that at least a portion of the light socket is located below the plane defined by the top surface of the motor.

In a fifth aspect of the invention, the trough is situated relative to the motor such that at least a portion of the light socket is located below the horizontal plane defined by the fan blade outer ends.

In a sixth aspect of the invention, the fan further includes a light housing around the motor, in which the pivoting light socket is situated such that at least a portion of the light socket is within the housing.

BRIEF DESCRIPTION OF THE DRAWINGS

Other objects and advantages of the invention will become apparent upon reading the following detailed description and upon reference to the drawings in which.

Figure 1:
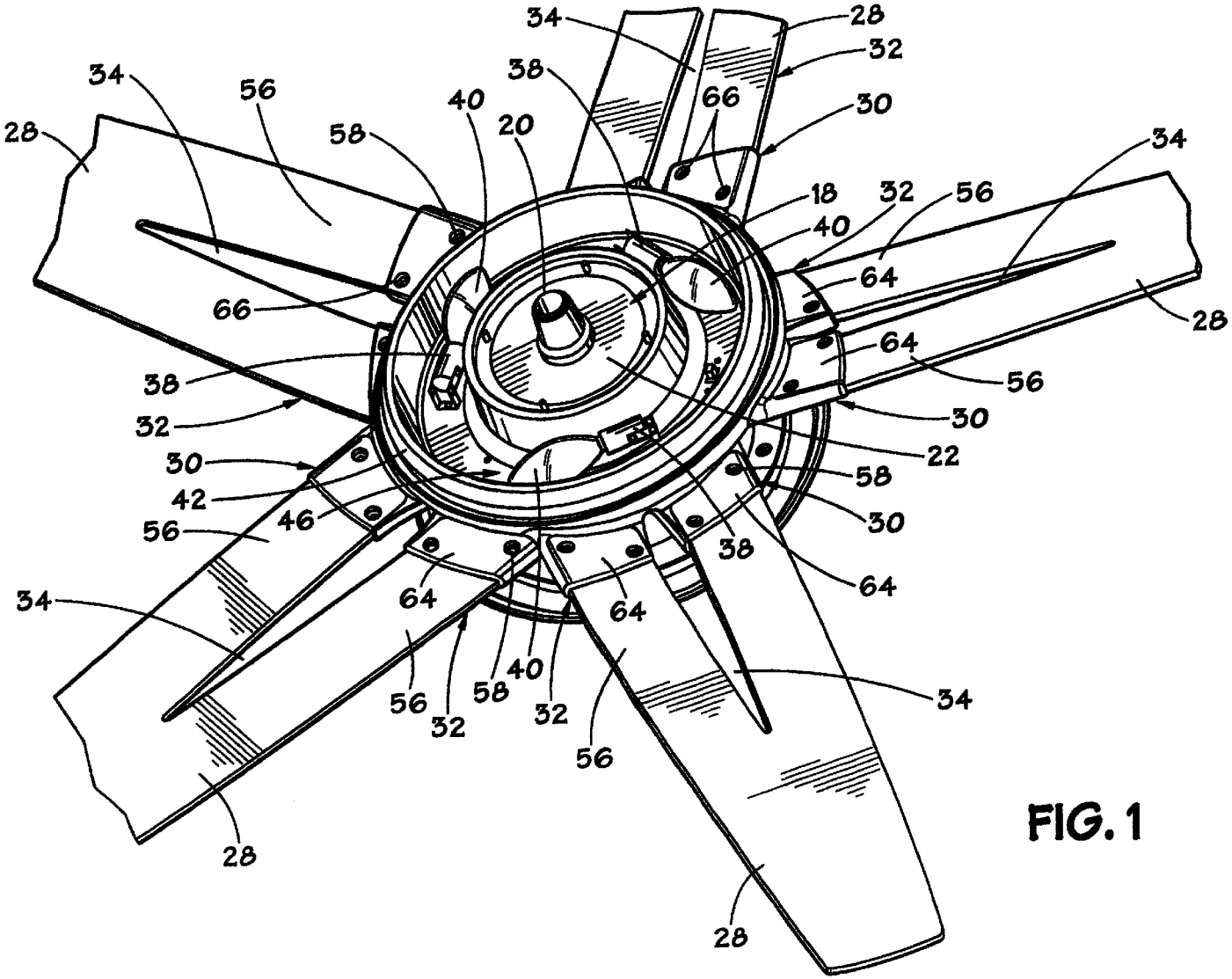
FIG. 1 is a perspective top view of a ceiling fan with an integral up-light employing a pivoting light socket placed inside the integral up-light in accordance with an embodiment of the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 2:
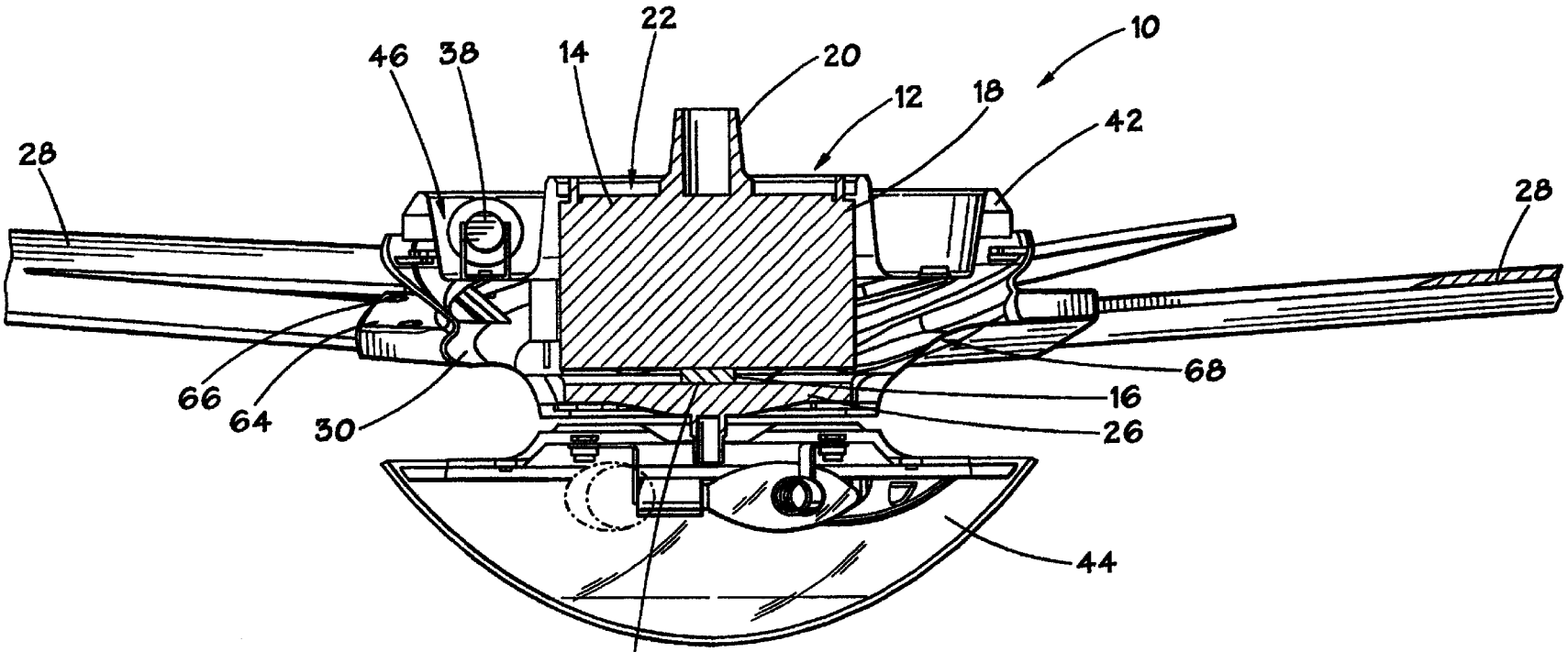
FIG. 2 is a cut-away elevation view of the pivoting light socket placed inside the ceiling fan with an integral up light illustrated in FIG. 1.

Turning to the drawings, FIG. 1 and FIG. 2 illustrate various views of a ceiling fan 10 employing a light socket 38 in accordance with an embodiment of the present invention. As shown in FIG. 1 and FIG. 2, the ceiling fan 10 includes a motor 12 which has a stationary portion, or stator 14, and a rotor 16 which rotates relative to the stator. The stator 14 has an upper portion 18, to which a collar 20 is attached. A down rod (not shown) couples to the collar 20 for suspending the fan 10 from a ceiling. The rotor 16 includes a lower portion 24, to which a generally disc-shaped hub 26 is fixed so as to rotate with the rotor 16. In one embodiment, the hub 26 is fashioned of rubber.

The ceiling fan 10 further includes a plurality of fan blades 28 and a corresponding plurality of blade holders 30. The blade holders 30 may be made using zinc die cast process. The embodiment pictured includes five fan blades 28 and five corresponding blade holders 30. The fan blades 28 include a first end 32, and one embodiment of the invention includes fan blades 28 having a "split" blade design, wherein the blade first end 32 defines a generally V-shaped cut-out 34. The blade holders 30 are coupled to the hub 26 so as to rotate therewith. In an embodiment of the invention, the hub 26 defines a plurality of threaded bores positioned around the periphery of the hub 26, with a series of corresponding bolts passing through openings in the lower portion 36 of the blade holders 30 and threaded into the hub 26 to couple the blade holders 30 to the hub 26.

The ceiling fan 10 further includes an integral "up-light" feature, which includes plurality of light sockets 38 coupled to the stator upper portion 18 for engaging light bulbs 40. In the embodiment pictured, the light sockets 38 are positioned within a light pan 42 coupled to the upper portion 18 of the stator 14 such that the illumination from the light bulbs 40 projects above the fan blades 30. The light pan 42 may be fashioned of stamped steel with a polished finish to reflect the light. Further, the light pan 42 may be further lined with a foil-faced insulator to further reflect the light away from the motor and also to reflect heat from the light bulbs 40.

In an embodiment of the invention, three light sockets 38 are positioned within the light pan 42, with three forty-watt incandescent light bulbs 40 engaged therein. Depending on the application, other types of light fixtures may be employed, such as a circular florescent lamp and associated fixture. The wiring for the light sockets 38 may be as in standard ceiling fans known in the art. The up-light feature of the ceiling fan 10 provides pleasant, indirect illumination, casting light upwards onto the ceiling rather than downwards towards the floor of a room. The ceiling fan 10 may optionally include an additional conventional lighting fixture 44, positioned below the motor 12. Since the ceiling fan illustrated in the drawings herein does not include a switch housing extending below the motor as in known ceiling fans, a threaded shaft may extend downward through the hub 26, to which a down-light kit may be connected and held in place with a threaded hub and a set screw.

In an embodiment of the invention, a remote control is provided which operates both the up-light feature and the optional conventional lighting fixture. The remote control may further control the fan blade 28 rotational speed and direction.

While many ceiling fan applications desire the indirect illumination provided by an up-light feature as in the present invention, the limited floor to ceiling distance in many rooms prevents its implementation with known up-light designs. With prior art ceiling fans, up-light fixtures are positioned above the fan motor. This increases the distance required between the fan motor and the ceiling. A conventional light fixture additionally positioned below the fan blades may hang dangerously far below the ceiling, creating a hazard, due to the combined distance of the down rod, up-light fixture, ceiling fan assembly, and down light fixture.

This problem is addressed in the present invention by coupling the light sockets 38 directly to the fan motor 12. The light pan 42 defines a circumferential trough 46 in which the sockets 38 are positioned. The light pan 42 is coupled to the top surface 22 of the motor stator 14, with the trough 46 situated relative to the stator 14 such that the light sockets 38 are located below the plane of the top surface 22. Moreover, as seen in FIG. 2, the trough 46 may be situated relative to the stator 14 such that at least a portion of each light socket 38 is located below a horizontal plane defined by the fan blade tips. Thus, the integral up-light feature provides the desirable upward illumination without requiring any additional ceiling clearance.

Because the light sockets 38 are positioned in the circumferential trough 46 such that the light sockets 38 are located below the plane of the top surface 22, the light sockets 38 and the light bulbs 40 are not easily seen from a person standing below the ceiling fan 10. Furthermore, the location of the light sockets 38 provides virtually no room for a person's hand to reach for the light bulb 40 inserted in the light sockets 38, especially when the light sockets 38 are conventional light sockets. Thus, to change a light bulb 40 inserted in a conventional light socket becomes a difficult task since one would necessarily have to grope for the light bulb 40 located in the circumferential trough 46.

In addition, a conventional light socket requires sufficient clearance for engaging and disengaging the bulbs to and from the socket, which limits the trough to a certain size and design.

The problems mentioned above are addressed in an embodiment of the present invention by employing pivoting light sockets as the light sockets 38. The pivoting light socket 38 is shown in greater detail in FIG. 6 and FIG. 7. The pivoting light socket 38 includes a means which allows the socket 38 to be pivoted from a resting or horizontal position with respect to the light pan 42 (see FIG. 6) to an upright or vertical position with respect to the light pan 42 (see FIG. 7). The pivoting light socket 38 is certainly not limited to pivoting only from a horizontal to a vertical position. That is, the pivoting light socket 38 is capable of pivoting the socket from its horizontal position to any other position that will enable one to easily engage or disengage a bulb to or from the socket.

Figure 6:
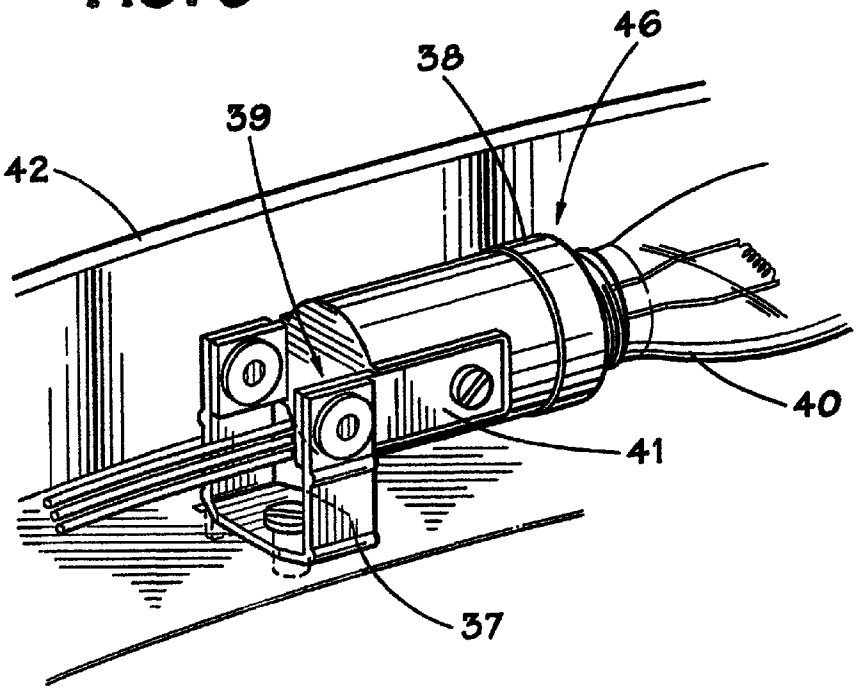
FIG. 6 illustrates a side view of the light socket in a position perpendicular to the light pan of the ceiling fan illustrated in FIG. 1.
Figure 7:
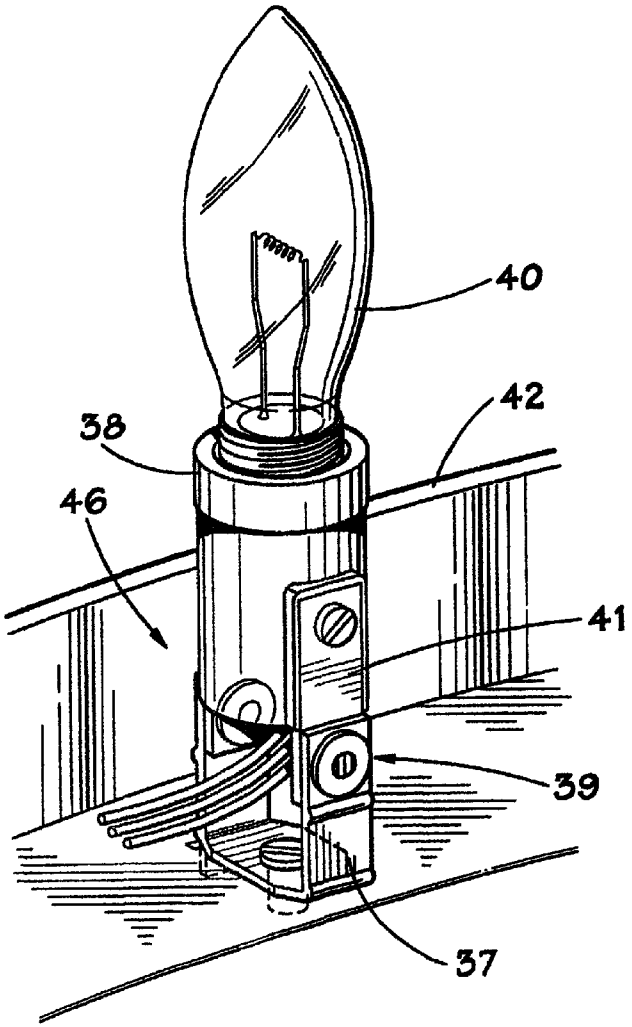
FIG. 7 illustrates a side view of the light socket pivoted in an upright position.
Figure 9:
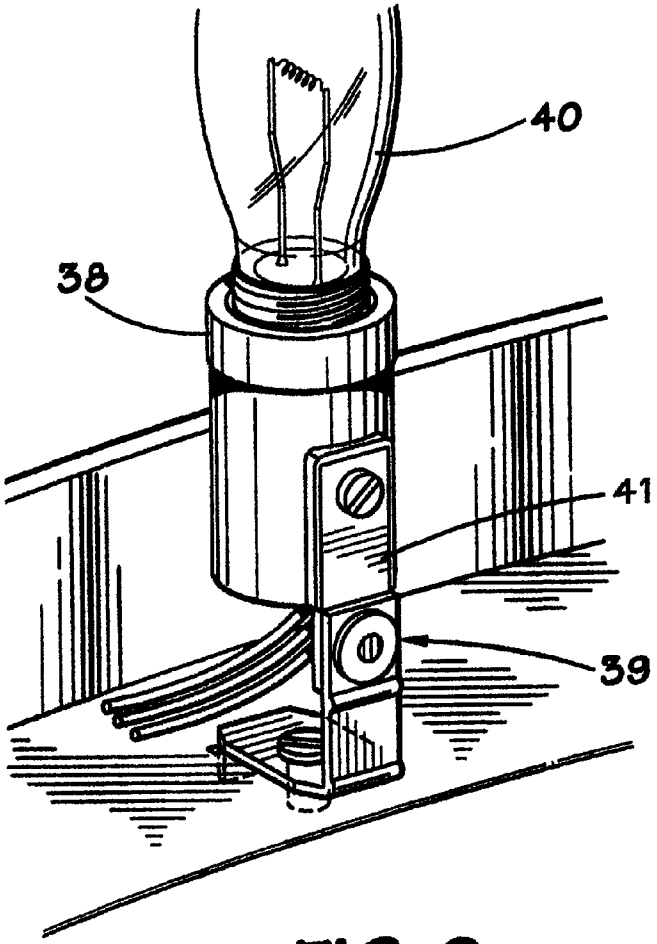
FIG. 9 illustrates a perspective view of another embodiment of the light socket having only one arm.
Figure 8:
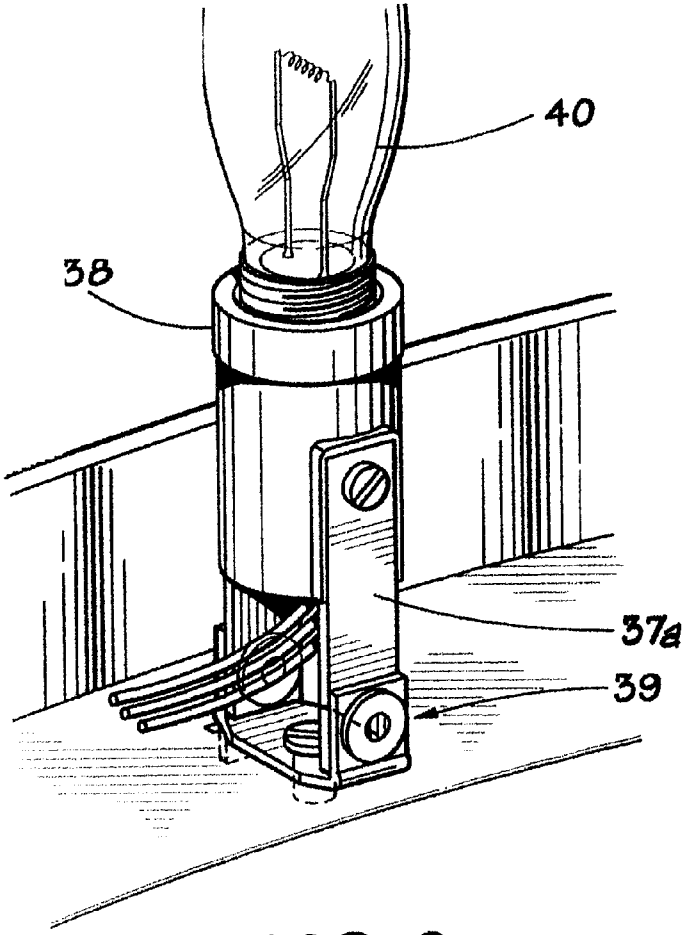
FIG. 8 illustrates an alternative embodiment of the light socket, similar to that shown in FIG. 7, with the pivot point located closer to the light pan of the ceiling fan.

In one embodiment in accordance with the present invention, the pivoting light socket 38 includes a pivoting member 39, which couples the light socket 38 to the light pan 42. The pivoting member 39 further includes a lower member 37 that is affixed to the light pan 42 and an upper member 41 that is attached to the light socket 38 itself. As shown in FIGS. 6–8, the lower member 37 and the upper member 41 comprises of parallel legs. However, in another embodiment of the present invention, the lower member 37 and upper member 41 may also be comprised of a singular leg, as shown in FIG. 9. The lower member 37 is connected to the upper member 41 in such a manner that allows the upper member 41 to pivot from being perpendicular to the lower member 37, as shown in FIG. 6, to being parallel or in line with the lower member 37, as shown FIG. 7. Any type of hinge, screw, rivets or the like may connect the lower member 37 to the upper member 41.

In another embodiment, the pivoting member 39 comprises an extension member 37*a* which is directly connected to the light pan 42, as shown in FIG. 8. The lower member 37 or the extension member 37*a* may be coupled to the light pan 42 by fasteners, rivets or the like. Since the extension member 37*a* is pivotably coupled to the light pan 42, the extension member 37*a* may easily pivot about the light pan 42.

Likewise, the upper member 41 may be attached to the light socket 38 by fasteners, rivets or the like. Moreover, the pivoting member 39 may be made from material such as metal or plastic or anything that is capable of pivoting the light socket 38 from its horizontal position to its vertical position with respect to the light pan 42.

The ceiling fan 10 additionally includes a blade holder 30. As discussed above, the blade holder 30 includes a lower portion 36 which is coupled to the hub 26. The blade holder 36 defines a ledge 50, to which the fan blade 28 attaches such that the fan blade 28 extends radially from the hub 26. The ceiling fan 10 illustrated in FIG. 1 and FIG. 2 includes the split-blade design as discussed above. Thus, as pictured in FIG. 3, two ledges 50 extend from the blade holder 30, each ledge 50 forming the floor of a channel 52 which includes two side walls 54 in a spaced relationship extending generally perpendicular to the floor 50. Each channel 52 receives one segment 56 (one side of the V-shaped cut out) of the fan blade 28.

The first end 32 of the fan blades 28 each defines at least one bore 58 therethrough. The split-blade embodiment pictured herein includes two bores 58 extending through each blade segment 56. Each channel floor 50 may include at least one retaining member 60 extending upwards therefrom. The blade holder 30 embodiment of FIG. 3 includes four retaining members 60, each being generally cylindrical in shape, corresponding to the bores 58 through the fan blades 28. At least a portion of the retaining member 60 extends through the bore 58 in the fan blade segment 56 seated within the channel 52. A fastener such as a screw 62 extends through the bores 58 and into the retaining member 60 to fix the fan blade 28 within the channel 52. Alternate fastening methods may be employed, such as providing openings in the channel floor 50, either in lieu of the retaining members 60 or in conjunction therewith, wherein a bolt extends through the channel floor 50 and the blade 28 with a nut threaded thereabout.

Figure 4:
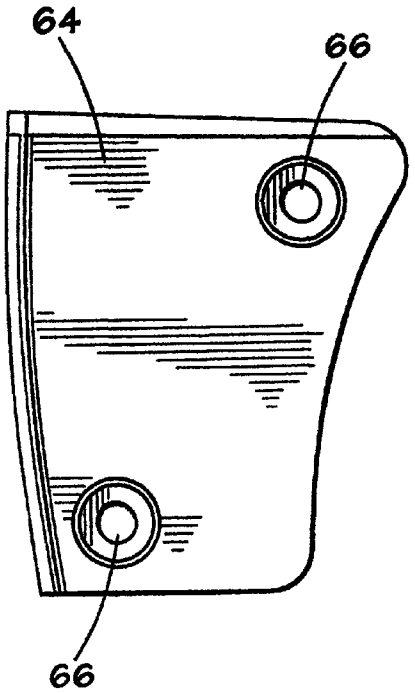
FIG. 4 illustrates a blade holder cover plate for the ceiling fan illustrated in FIG. 1.

A cover plate 64 may fit over the fan blade segment 56 such that it is sandwiched between the channel floor 50 and the cover plate 64. An embodiment of the cover plate 64 is illustrated in FIG. 4. The cover plate 64 further defines a bore 66 extending therethrough having an axis common to the bores 58 extending through the fan blades 28. The fastener 62 extends through the cover plate 64 and the fan blade 28, terminating in the retaining member 60 for fixing the fan blade 28 in its sandwiched position between the floor 50 and the cover plate 64. This configuration for fixing the fan blade 28 to the blade holder 30 is best illustrated in FIG. 1.

Figure 3:
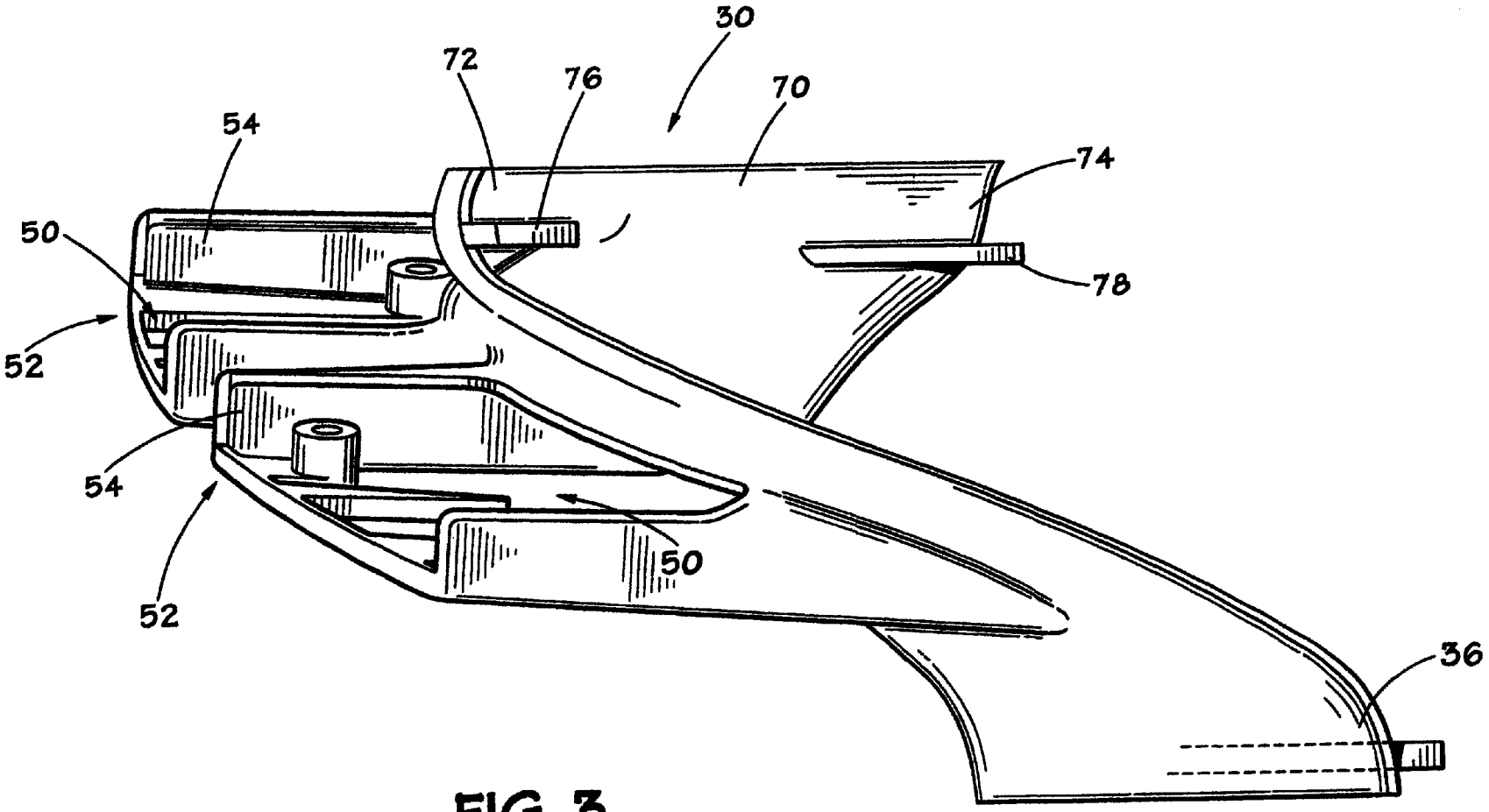
FIG. 3 is a perspective view of a blade holder of the ceiling fan illustrated in FIG. 1.
Figure 5:
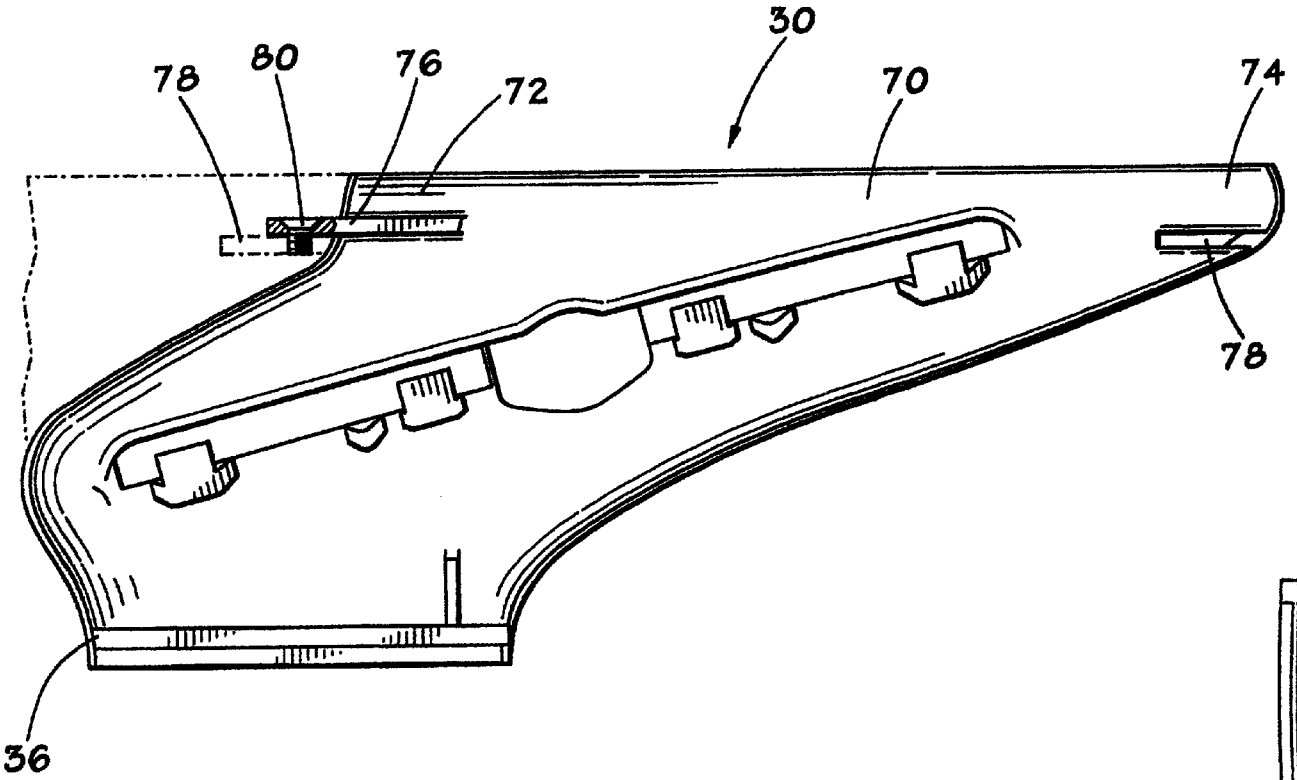
FIG. 5 illustrates a plan view of the blade holder shown coupled to an adjacent blade holder.

The blade holders 30 form an interlocking segment of a motor-concealing member 68 which rotates about the motor 12 with the hub 26. FIG. 5 shows an alternate view of the blade holder 30, which includes an upper portion 70 having first 72 and second 74 ends arranged such that the first end 72 of one blade holder 30 is coupled to the second end 74 of the adjacent blade holder. As shown in FIG. 3 and FIG. 5, each end 72 and 74 of the upper portion 70 defines a tab 76 and 78, respectively, extending therefrom, with one tab being positioned on a plane lower than the other, so that when adjacent blade holders are positioned in an abutting relationship, the tabs 76 and 78 overlap. A fastener 80 such as a nut and bolt or rivet couples the blade holders 30 together. Thus, the blade holders 30 having their upper portions 70 coupled together and their lower portions 36 coupled to the hub 26 form a dish-like member 68 which conceals the motor 12. The light pan 42 may be positioned such that at least a portion of the light sockets 38 within the circumferential trough 46 are below the upper portion 70 such that the motor-concealing member 68 also rotates about the trough 46.

The novel blade holders 30 of the invention provide several benefits. First, the blade holders 30 couple the fan blades 28 to the rotor 16 in a very robust manner. Known ceiling fans typically use a flange having one end to which a fan blade is attached with bolts or screws, with the opposite end bolted to the fan's rotor. In contrast, the novel blade holder 30 of the present invention uses the combination of the channel 52 and cover plate 64 to "surround" the fan blade 28 and hold it securely in place.

Next, the blade holder lower portions 36 coupled to the hub 26, and the upper portions 70 are each coupled to the adjacent blade holder, forming an integral unit 68. The upper portion 70 and the lower portion 36 each form a concentric ring, which provides better balance for the fan blades. A common problem with known ceiling fans is the "wobble" caused by unbalanced blades. This problem is greatly reduced in a ceiling fan employing blade holders 30 in accordance with the present invention.

Moreover, the combined blade holders 30 form a motor-concealing member 68 which rotates with the hub 26. This eliminates the need for a decorative motor housing, and the cost associated therewith. Additionally, the motor-concealing member 68 rotates about the motor 12, moving the air around the motor 12 and cooling it. Still further, in one embodiment, the light sockets 38 in the circumferential trough 46 are positioned such that at least a portion of the light bulbs 40 are located below the top plane of the motor concealing member 68. Thus, the rotating motor concealing member 68 also cools the light bulbs 40 within the circumferential trough 46. The circumferential trough 46 also further conceals the motor 12.

Thus, the ceiling fan 10 of the present invention provides an improved, integral up light feature which provides desired indirect lighting without requiring additional ceiling-clearance. Further, the blade holders 30 of the invention couple the fan blades 28 to the rotor 16 of the ceiling fan motor 12 in a stable, robust manner, which improves the ceiling fan's 10 balance. The pivoting light sockets 38 in the up light, moreover, provide more visibility for the sockets 38 and the light bulbs 40 and ease for accessing the light bulbs 40. They further reduce the space between the trough and the socket necessitated by conventional sockets for threading and unthreading bulbs. The motor-concealing member 68 with the fan blades 30 coupled thereto provides a single, integrated rotating unit which provides a sleek, low profile appearance and functions to cool the fan motor 12 and the up-light fixture, while eliminating the need to provide an additional, costly decorative motor housing.

The above description of exemplary embodiments of the invention are made by way of example and not for purposes of limitation. Many variations may be made to the embodiments and methods disclosed herein without departing from the scope and spirit of the present invention. Alternate embodiments are envisioned which include varying numbers and styles of fan blades. Other embodiments may include integral down-light fixtures. The present invention is intended to be limited only by the scope and spirit of the following claims.

What is claimed is:

1. A ceiling fan comprising:

a motor including a stator having an upper portion and a rotor having a lower portion, the rotor being rotatable with respect to the stator;

a plurality of fan blades, each fan blade having a first end coupled to the lower portion of the rotor; and at least one light socket assembly coupled to the upper portion of the stator, each light socket assembly having a socket for engaging a light bulb, wherein the socket is movable from a first position to a second position.

2. The ceiling fan of claim 1, wherein each light socket assembly comprises:

an arm having lower and upper members, wherein the upper member is coupled to the light socket, and wherein the lower member is coupled to the upper portion of the stator.

3. The ceiling fan of claim 2, wherein the upper member is movable relative to the lower member.

4. The ceiling fan of claim 2, wherein the upper member is pivotably attached to the lower member.

5. The ceiling fan of claim 1, wherein the first position comprises the light socket being substantially parallel to the upper portion of the stator.

6. The ceiling fan of claim 1, wherein the second position comprises the light socket being substantially perpendicular to the upper portion of the stator.

7. The ceiling fan of claim 1, wherein the second position comprises the light socket being at an angle with the upper portion of the stator.

8. The ceiling fan of claim 1, wherein each light socket assembly comprises:

an extension arm, wherein the extension arm is coupled to the light socket at a first end and pivotably attached to the upper portion of the stator at a second end, such that the extension member is pivotable from a first position to a second position.

9. The ceiling fan of claim 8, wherein the first position comprises the socket being substantially parallel to the upper portion of the stator.

10. The ceiling fan of claim 8, wherein the second position comprises the socket being substantially perpendicular to the upper portion of the stator.

11. The ceiling fan of claim 8, wherein the first position comprises the socket being at an angle to the upper portion of the stator.

12. The ceiling fan of claim 1, wherein the light socket assembly is configured such that the illumination from the light bulb engaged therein projects above the fan blades.

13. The ceiling fan of claim 1, further comprising a light pan coupled to the upper portion of the stator with the at least one light socket assembly situated within the light pan.

14. The ceiling fan of claim 13, wherein the light pan defines a circumferential trough and wherein the at least one light socket assembly is positioned within the trough.

15. The ceiling fan of claim 14, wherein the stator defines a top surface, the top surface defining a plane, and wherein the trough is situated relative to the stator such that at least a portion of the light socket assembly is located below the plane defined by the top surface.

16. The ceiling fan of claim 14, wherein the fan blades each include a second end opposite the first end, the second ends defining a horizontal plane, and wherein the trough is situated relative to the stator such that at least a portion of the light socket assembly is located below the horizontal plane defined by the fan blade second ends.

17. The ceiling fan of claim 14, further comprising a housing around the motor, wherein the housing is situated relative to the trough such that at least a portion of the at least one light socket assembly is within the housing.

18. A light fixture for a ceiling fan including a motor having a stator defining a top surface, a rotor having a plurality of blades attached thereto, the blades each having a distal end extending radially from the motor, the light fixture comprising:

a light pan coupled to the top surface of the stator, the light pan defining a circumferential trough; and at least one light socket assembly positioned within the trough, each assembly having a socket for engaging a light bulb, wherein the socket is movable from a first position within the trough to a second position extending out of the trough.

19. The light fixture of claim 18, wherein the first position comprises the socket being substantially parallel to the trough.

20. The light fixture of claim 18, wherein the second position comprises the socket being substantially perpendicular to the trough.

21. The light fixture of claim 18, wherein the second position comprises the socket being at an angle with the trough.

22. The light fixture of claim 18, wherein the trough is situated relative to the stator such that at least a portion of the light socket assembly is located below a plane defined by the top surface of the stator.

23. The light fixture of claim 18, wherein the fan blade distal ends define a horizontal plane, and wherein the trough is situated relative to the stator such that at least a portion of the light socket assembly is located below the horizontal plane defined by the fan blade distal ends.

24. The light fixture of claim 18, wherein each light socket assembly further comprises: an arm having lower and upper members, wherein the upper member is coupled to the light socket, and wherein the lower member is coupled to the trough.

25. The light fixture of claim 24, wherein the lower member is pivotably attached to the upper member.

26. The light fixture of claim 18, wherein each light socket assembly further comprises: an extension arm coupled to the light socket at one end and pivotably coupled to the trough at a second end.

* * * * *